United States Patent [19]

Ishii

[11] Patent Number: 4,879,950

[45] Date of Patent: Nov. 14, 1989

[54] IMAGE POSITION ADJUSTING APPARATUS OF ROTARY PRESS MACHINE

[75] Inventor: Koji Ishii, Hiroshima, Japan

[73] Assignee: Ryobi Ltd., Hiroshima, Japan

[21] Appl. No.: 207,559

[22] Filed: Jun. 16, 1988

[30] Foreign Application Priority Data

Jun. 19, 1987 [JP] Japan ..... 62-154039
Jul. 20, 1987 [JP] Japan ..... 62-181816

[51] Int. Cl.[4] ..... B41F 13/14; B41F 13/20
[52] U.S. Cl. ..... 101/217; 101/248
[58] Field of Search ..... 101/248, 181, 218, 217; 384/255, 256

[56] References Cited

U.S. PATENT DOCUMENTS 4,336,755 6/1982 Liska ..... 101/248
4,572,074 2/1986 Guaraldi ..... 101/248

*Primary Examiner*—J. Reed Fisher
*Attorney, Agent, or Firm*—Sughrue, Mion, Zinn, Macpeak & Seas

[57] ABSTRACT

A mechanism for adjusting an image position on a printing cylinder in a rotary press adjusts the position by sliding or moving the printing cylinder transversely relative to a rubber cylinder. The mechanism includes a transverse adjusting mechanism and a vertical adjusting mechanism which each have bevel gears. A handle is fixed to a central shaft of the printing cylinder at one side of the cylinder and outside the housing of the rotary press, so that an operator can adjust the image position without having to go to a second side of the machine frame. In the image adjusting operation, the printing cylinder slides along its axis to adjust the transverse position of the image and the printing cylinder gear slides along its axis to control the vertical position of the image.

10 Claims, 9 Drawing Sheets

IMAGE POSITION ADJUSTING APPARATUS OF ROTARY PRESS MACHINE

BACKGROUND OF THE INVENTION

The present invention relates to a mechanism in a rotary printing machine for adjusting the position at which an image is printed. More particularly, the invention relates to an image position adjusting mechanism having a printing cylinder, a rubber cylinder, and pressure cylinders, in which adjusting mechanism the printing cylinder slides along its axis to transversely adjust the printing position of the image and a gear of the printing cylinder slides along its axis to vertically adjust the printing position, e.g., with respect to a substrate upon which the image is to be printed.

Apparatus of this type are well known. One such apparatus is disclosed in Japanese Unexamined Patent Publication No. 56504/78. According to the image position adjusting apparatus shown in the Japanese Publication, a printing cylinder and a printing cylinder axis are integrally assembled and a drive gear is mounted outside a frame of the printing apparatus. An image transverse position adjusting knob is positioned inside a housing on one side of the apparatus, and an image vertical position adjusting knob is inside the housing at the other side. The printing cylinder shaft is rotatable and slidable relative to bearings provided on the frame or housing of the printing machine.

Vertical adjustments of the image in the conventional machine cannot be carried out by an operator standing at the one side of the printing machine, so coarse vertical adjustments cannot easily be repeated, especially when transverse adjustments are performed between vertical adjustments. In addition, access to the adjusting knobs is hindered because they are provided inside the machine frame, and construction of the machine is expensive due to a complicated bearing structure.

SUMMARY OF THE INVENTION

It is an object of the present invention to provide a novel image position adjusting mechanism for a rotary printing machine which mechanism avoids all of the above-noted problems of conventional mechanisms.

The image adjusting mechanism enables an operator to adjust the position at which a printing cylinder of the printing machine prints the image on a material (paper). The position can be adjusted in two directions, e.g. vertically and horizontally with respect to the paper. Adjustment of the position of the image in a vertical direction is achieved by a rotation of the printing cylinder relative to a rubber cylinder or material (paper) on the rubber cylinder on which paper the image is to be printed. Horizontal (transverse) adjustment is achieved by sliding the printing cylinder in its axial direction relative to the rubber cylinder or paper. Therefore, the printing machine can accommodate changes in size of the paper as well as changes in the position at which the image is to be printed on the paper.

In accordance with a first embodiment of the present invention, an image transverse position adjusting mechanism and an image vertical position adjusting mechanism, respectively, are accessible from outside the machine frame and from the same (operative) side thereof. In addition, an image vertical position rough adjusting mechanism is placed on the operative side, between the frame and the printing cylinder, so that both the image transverse and vertical adjustments can be performed by an operator at the operative side of the printing machine. Furthermore, the above adjustments can be performed, when the machine is running, without the aid of tools and while watching printing, to enable quick and precise adjustments. If necessary, a rough vertical adjustment of the image can be easily carried out by the adjusting device by operating a mechanism between the outer frame and the printing cylinder, resulting in a simple construction of the machine. A drive force transmitting mechanism can be installed at any place outside the machine frame.

In the first embodiment of the image position adjusting apparatus, a printing cylinder is slidable to adjust the transverse position of the image and a printing cylinder gear is slidable to adjust the vertical position of the image. The adjusting apparatus has an image transverse position adjusting mechanism which includes a cylinder shaft, for rotatably supporting the printing cylinder, which shaft is slidably supported by a bearing on the machine frame. The apparatus also includes a holder mounted on the bearing so as to rotatably support an end portion of the shaft which passes through a bearing on the frame at the operative side of the machine, a handle which is movable along its axis, an image vertical position adjustment mechanism, and an image vertical position rough adjusting mechanism. The image vertical position adjusting mechanism includes: a slide gear which is axially reciprocatable and which engages a gear at the operative side; a holder rotatably supported on the printing cylinder and slidable through the slide gear; and a printing cylinder bevel gear rotatably supported on the holder through a compression spring and a drive pin positioned between the printing cylinder and the bevel gear. The slide gear is rotatable from outside the frame on the operative side. The bevel gear of the printing cylinder engages a rubber cylinder. The bevel gear and the slide gear form a gear transmission mechanism which is outside the frame on the operative side. The image vertical position rough adjusting mechanism includes a pinion, a rotary pin for rotatably supporting the pinion on the printing cylinder bevel gear, and a segment gear secured to the holder.

In accordance with a second embodiment of the image position adjusting apparatus of the present invention, an image transverse position adjusting mechanism and an image vertical position adjustment mechanism are placed outside the frame at the operative side, so that the transverse and vertical adjustments can be performed at the operator's side of the rotary press without walking around the machine housing. Furthermore, the adjustments mentioned above can be carried out quickly and precisely during operation of the machine, without any special tool and while watching the printing condition. A drive force transmitting mechanism can be installed freely at any place outside the frame. The adjusting apparatus of the second embodiment has a printing cylinder and a printing cylinder gear. The printing cylinder is slidable along its axis to adjust the transverse position of the image and the printing cylinder gear is slidable along its axis to adjust the vertical position. The apparatus includes an image transverse position adjusting mechanism and an image vertical position adjusting mechanism. The image transverse position adjusting mechanism includes: a printing cylinder gear rotatably supporting the printing cylinder which is in turn slidably supported in a bearing of the machine frame; a handle on which an end of the printing cylinder gear which extends through the bearing and the operator's side frame; and a holder extending from the bearing. The handle is threadedly engaged with the holder so as to freely move along its axis. The image vertical position adjusting mechanism includes: a slide gear threadedly engaged with a gear positioned at the operator's side so as to be freely movable along its axis: and a printing cylinder bevel gear slidable along its axis by means of the slide gear. The bevel gear is also rotatably and slidably supported on the printing cylinder in a space between the printing cylinder and the slide gear by means of a compression spring and drive pin. The printing cylinder engages a rubber cylinder gear and the slide gear is rotatably disposed and extends outside the operator's side of the machine frame.

DETAILED DESCRIPTION OF THE PREFERRED EMBODIMENTS

The inventive apparatus enables an operator to change or adjust the position at which a printing cylinder of a printing machine prints an image on a material (paper). The position can be adjusted in two directions, e.g. vertically and horizontally with respect to the paper. Adjustment of the position of the image in a vertical direction is achieved by a rotation of the printing cylinder relative to a rubber cylinder or paper on the rubber cylinder. Horizontal (transverse) adjustment is achieved by sliding the printing cylinder in its axial direction relative to the rubber cylinder or paper. Therefore, the printing machine can accommodate changes in size of the paper as well as changes in the position in which the image is to be printed on the paper.

The first embodiment of the image adjusting apparatus of the invention will be described in detail with reference to FIGS. 1 to 7.

Figure 1:
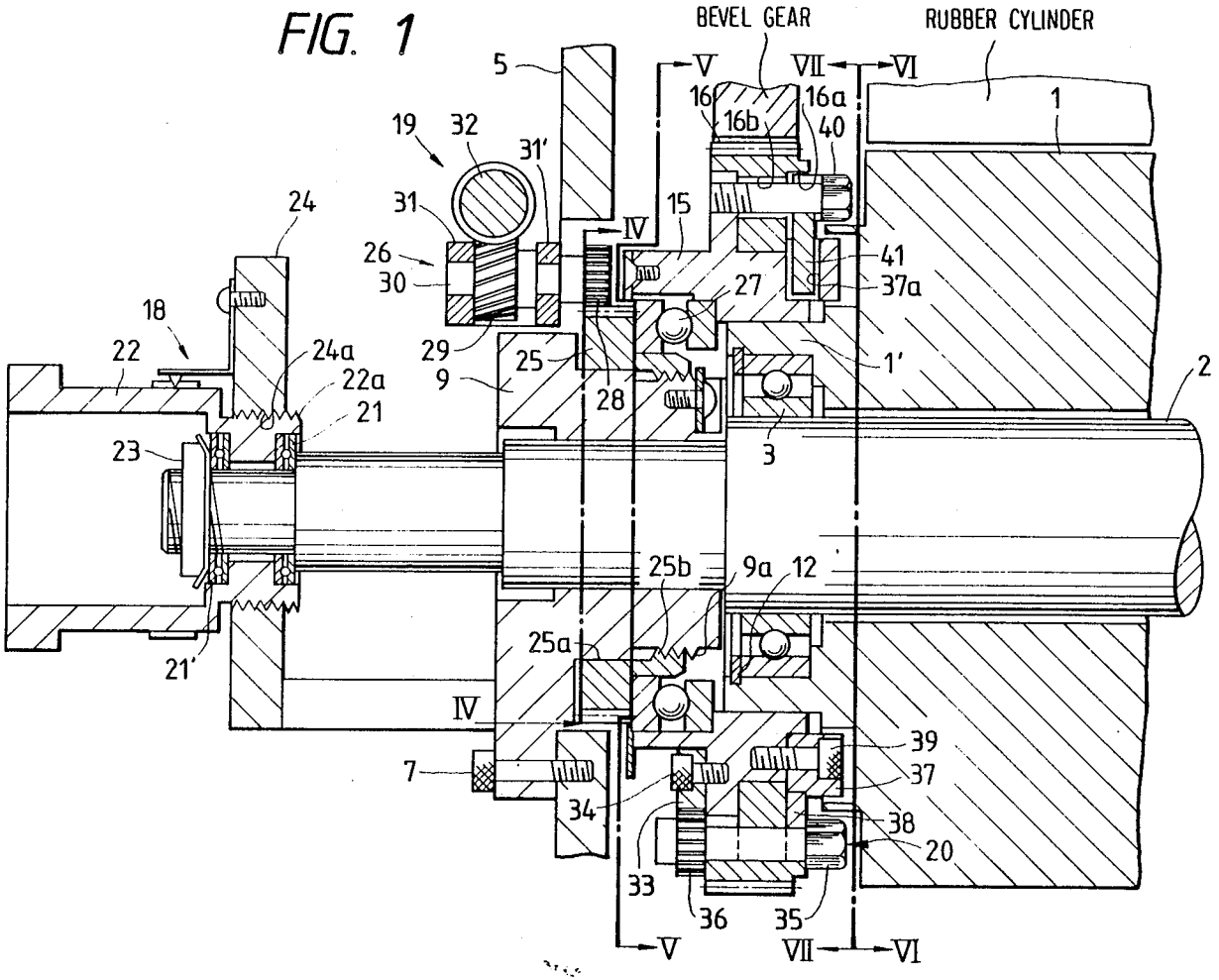
FIG. 1 is a cross-sectional side view of a first side of a printing cylinder of a first embodiment of an image adjusting apparatus in a rotary press according to the present invention.
Figure 2:
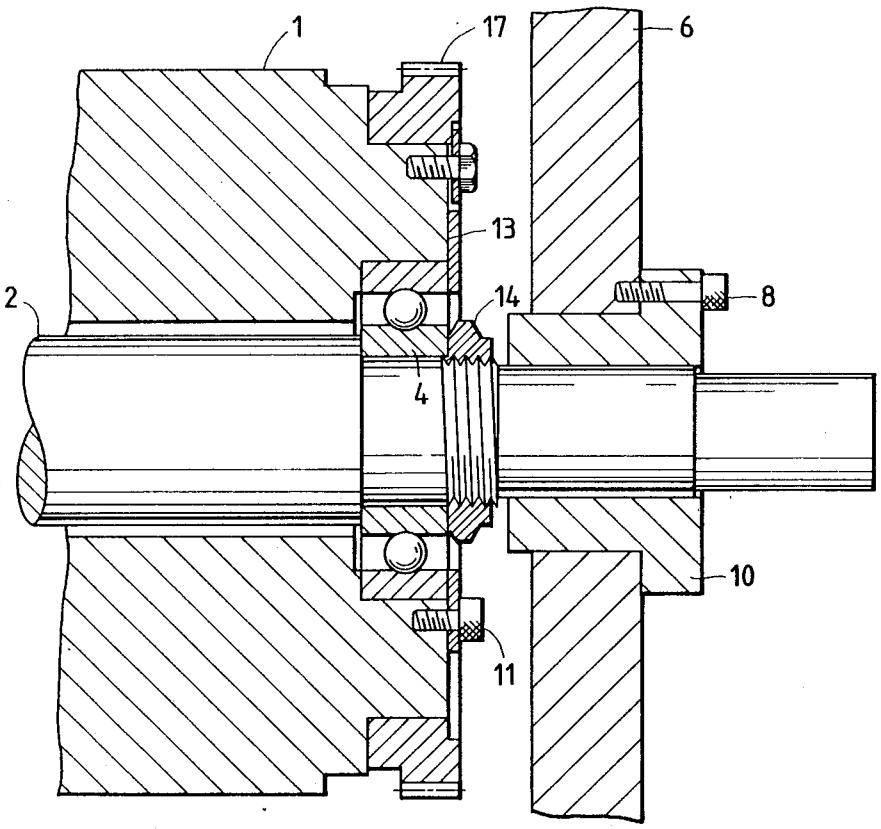
FIG. 2 is a cross-sectional side view of a second side of the printing cylinder of the first embodiment.
Figure 3:
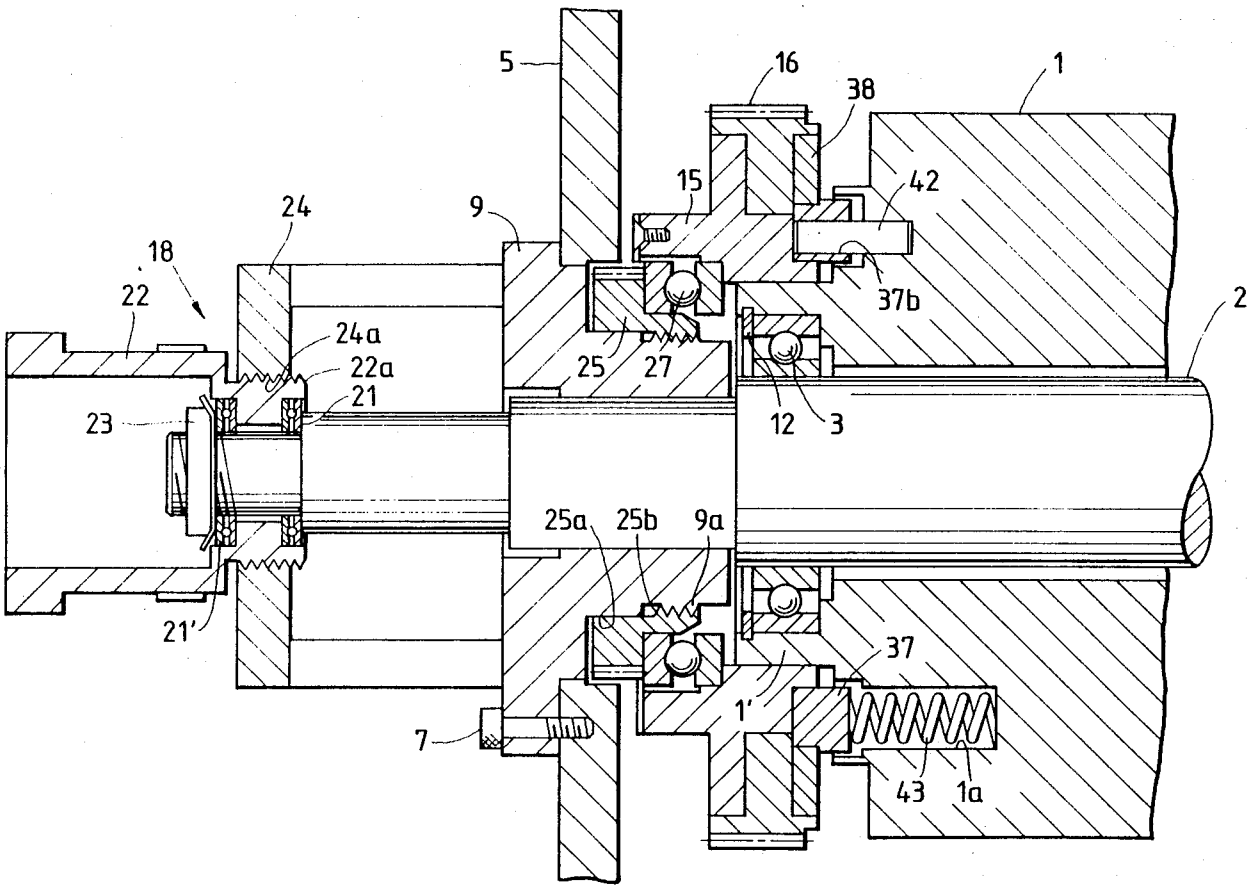
FIG. 3 is a cross-sectional side view of the first side of the printing cylinder of the first embodiment, and is sectioned along a different line than that of FIG. 1.
Figure 4:
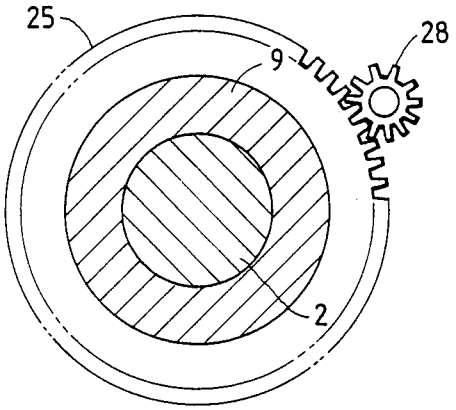
FIGS. 4, 5, 6, 7 and 8 are cross-sectional views of the printing cylinder of FIG. 1 taken along lines IV—IV, V—V, VI—VI, VII—VII and VIII—VIII, respectively.
Figure 5:
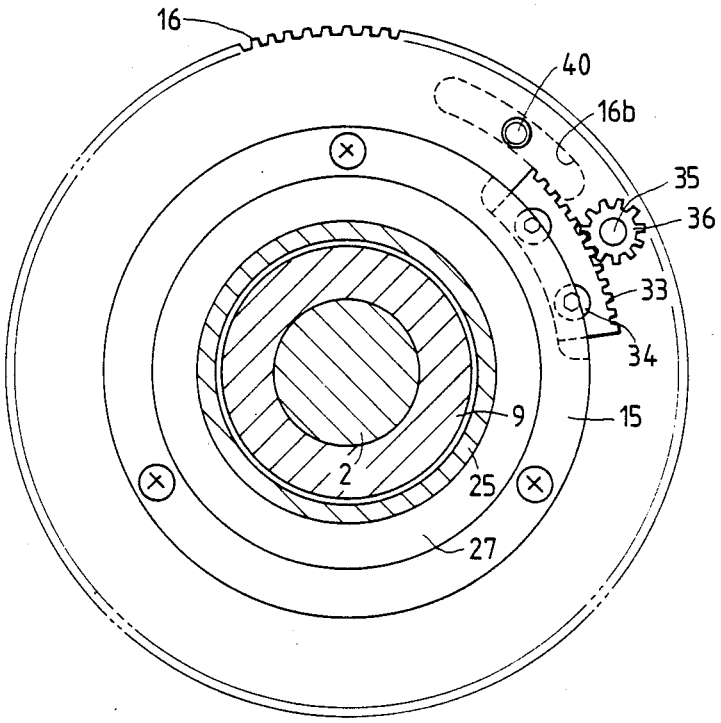
Figure 6:
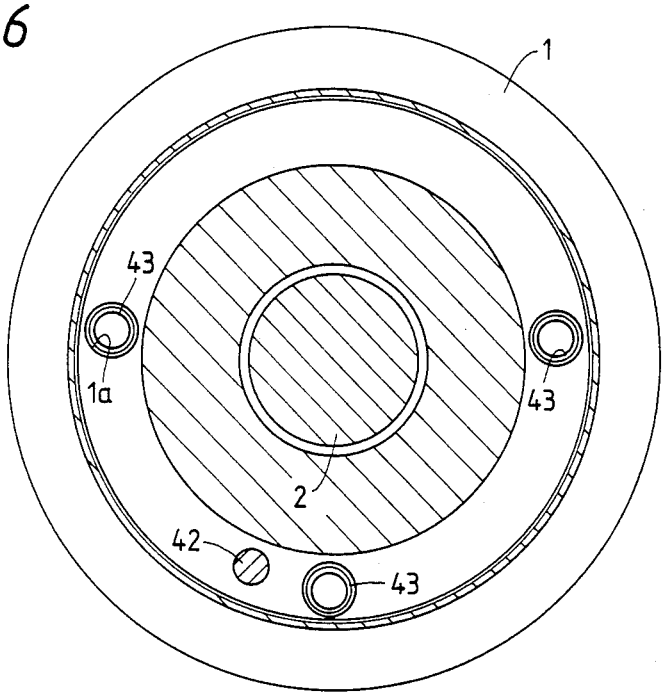

As depicted in FIGS. 1 to 3, a printing cylinder 1 is supported at first and second sides of a printing cylinder shaft 2 through bearings 3 and 4 for rotation relative to the shaft. However, the cylinder 1 is not axially movable with respect to the shaft. Bearings 9 and 10 are respectively fixed on a first (operative) side frame 5 and a second (opposite-operative) side frame 6. The shaft 2 passes through the bearings 9 and 10 and is axially slidable with respect to them. Thus, the cylinder 1 moves axially together with the shaft 2. A housing can be provided around the side frames 5 and 6 or be formed so as to include the side frames.

The bearings 3 and 4 are securely fixed to the printing cylinder 1 by means of a nut 14 and stop rings 12 and 13 secured to the printing cylinder 1 with screws 11 or the like. A ring-like portion 1 of the cylinder 1 protrudes along the axis of the cylinder and is situated on the first side of the cylinder. A bevel gear 16 of the cylinder 1 is rotatably placed around a holder 15 and engages another bevel gear of a rubber cylinder (not shown). An ink driving gear 17 is attached to the cylinder 1 at its second side.

At the first side of the printing cylinder 1, there is an image transverse position adjusting mechanism 18 and an image (fine) vertical position adjusting mechanism 19. Between the printing cylinder 1 and the first side frame 5, there is an image vertical position rough adjusting mechanism 20.

The transverse adjusting mechanism 18 is constructed as set forth below.

A handle 22 is secured by means of the thrust bearings 21 and 21' on an end of the shaft 2 which extends through the bearing 9 such that the handle is rotatable, but not slidable, with respect to the shaft 2. The handle 22 is axially fixed to the shaft by a nut 23. If desired, the axial position of the handle with respect to the shaft can be adjusted by tightening or loosening the nut and using a washer.

A threaded portion **22*a* of the handle extends axially from its inner surface and engages a threaded hole 24*a* formed through a holder 24. The holder 24 is fixed on the outside portion of the bearing 9. Rotation of the handle with respect to the shaft will cause the handle, and thus the shaft, to move axially with respect to the holder 24 and bearing 9, due to the threaded engagement of the handle with the holder. Consequently, when the shaft 2 slides axially, together with the printing cylinder 1, the phase of the printing cylinder 1** changes and differs from that of the rubber cylinder to transversely adjust the position of the image being printed.

The vertical adjusting mechanism 19 is constructed as set forth below.

A slide gear 25, having a threaded portion **25*b*, is movably fitted along the axis in a central hole 25*a*. A gear transmission mechanism 26, placed outside the first side frame 5, can be used to rotate the slide gear 25 in either rotational direction, which will cause the gear 25 to reciprocate with respect to the cylinder 2. Vertical adjustment of the printing position (i.e. rotational adjustment of the printing cylinder with respect to the rubber cylinder or paper) is achieved by axially sliding the bevel gear 16 together with the holder 15 by means of the slide gear 25 and the thrust gear (bearing) 27. Because the gear of the bevel gear 16 engages with the bevel gear of the rubber cylinder (not shown), the axial movement of the bevel gear 16 rotates the printing cylinder 1** a small amount along its peripheral direction so as to finely adjust the vertical position of the image.

The gear transmission mechanism 26 has a rotary shaft 30, which shaft has an inner pinion 28 (FIGS. 1 and 4) and an outer bevel gear 29 (FIG. 1). The shaft 30 is rotatably supported by bearings 31 and 31' situated outside the frame 5 and is parallel to the shaft 2. The pinion 28 engages with the slide gear 25. The bevel gear 29 engages with a bevel gear 32 which is also rotatably supported and disposed outside the frame 5. The bevel gear 32 can be rotated by means of a handle (not shown), and the slide gear 25 will move in response thereto.

The vertical coarse adjusting mechanism 20 is constructed as described below.

A segment gear 33 (FIGS. 1 and 5) is secured to a side face of the holder 15 by a set of screws 34. The gear 33 is disposed inside the frame 5. A pinion 36 is rotatably journaled on the holder 15 by means of a rotary pin 35 which passes through the bevel gear 16 so as to engage the segment gear 33. The rotary pin 35 is accessible via a space provided between the printing cylinder 1 and the bevel gear 16.

Figure 7:
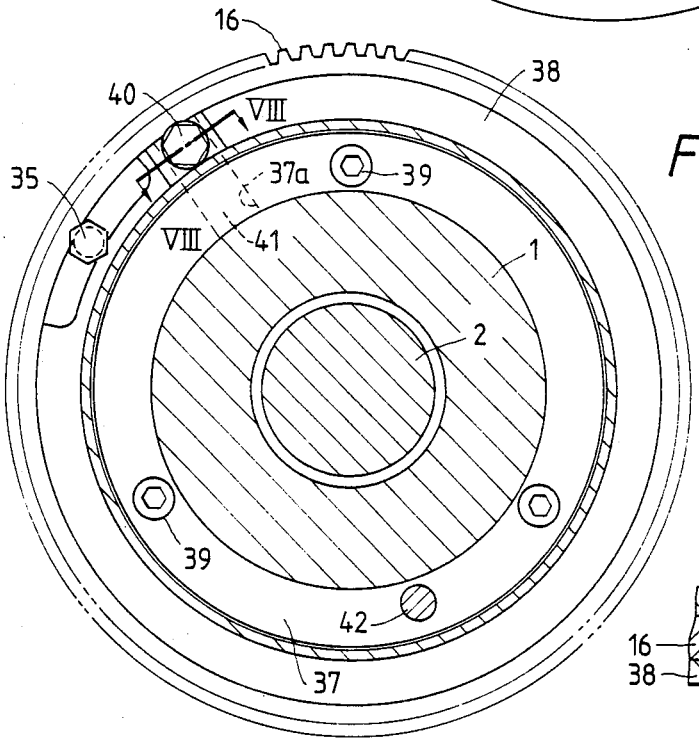

As shown in FIGS. 1, 3 and 7, a ring collar 37 and a lock plate 38 having a diameter larger than that of the ring collar are concentrically placed on a side face of the holder 15 which faces the cylinder 1.

Figure 8:
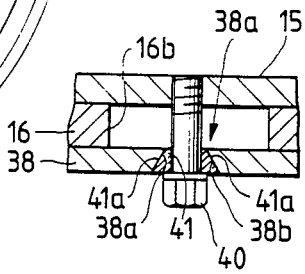
Figure 9:
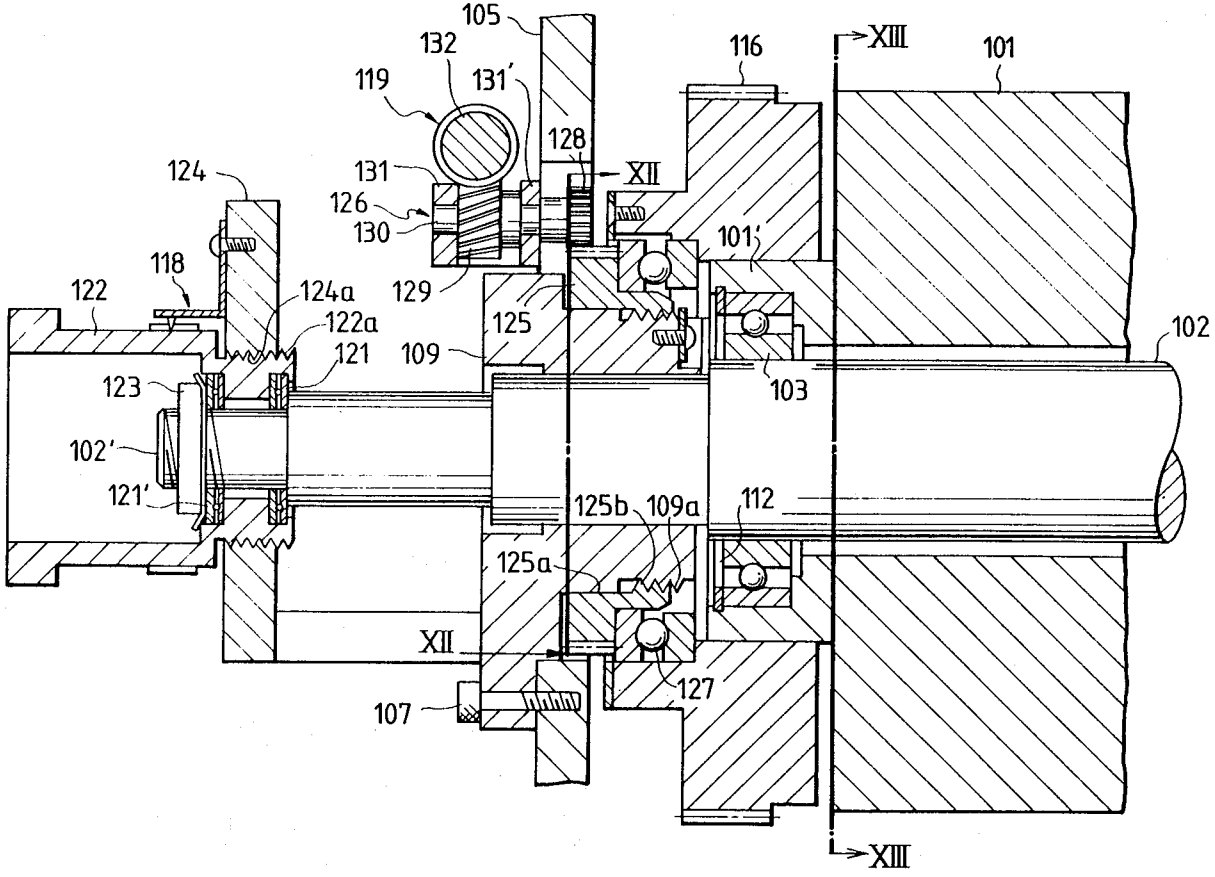
FIG. 9 is a cross-sectional side view of a first side of a printing cylinder according to a second embodiment of the invention.
Figure 10:
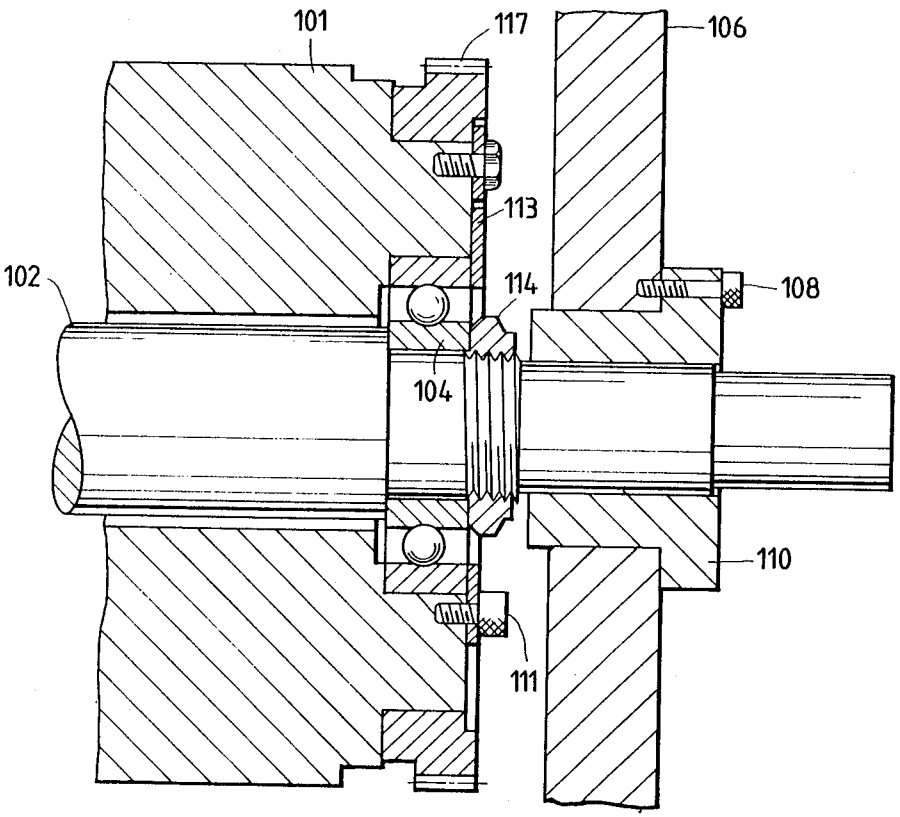
FIG. 10 is a view similar to that in FIG. 2 but showing the second embodiment.
Figure 11:
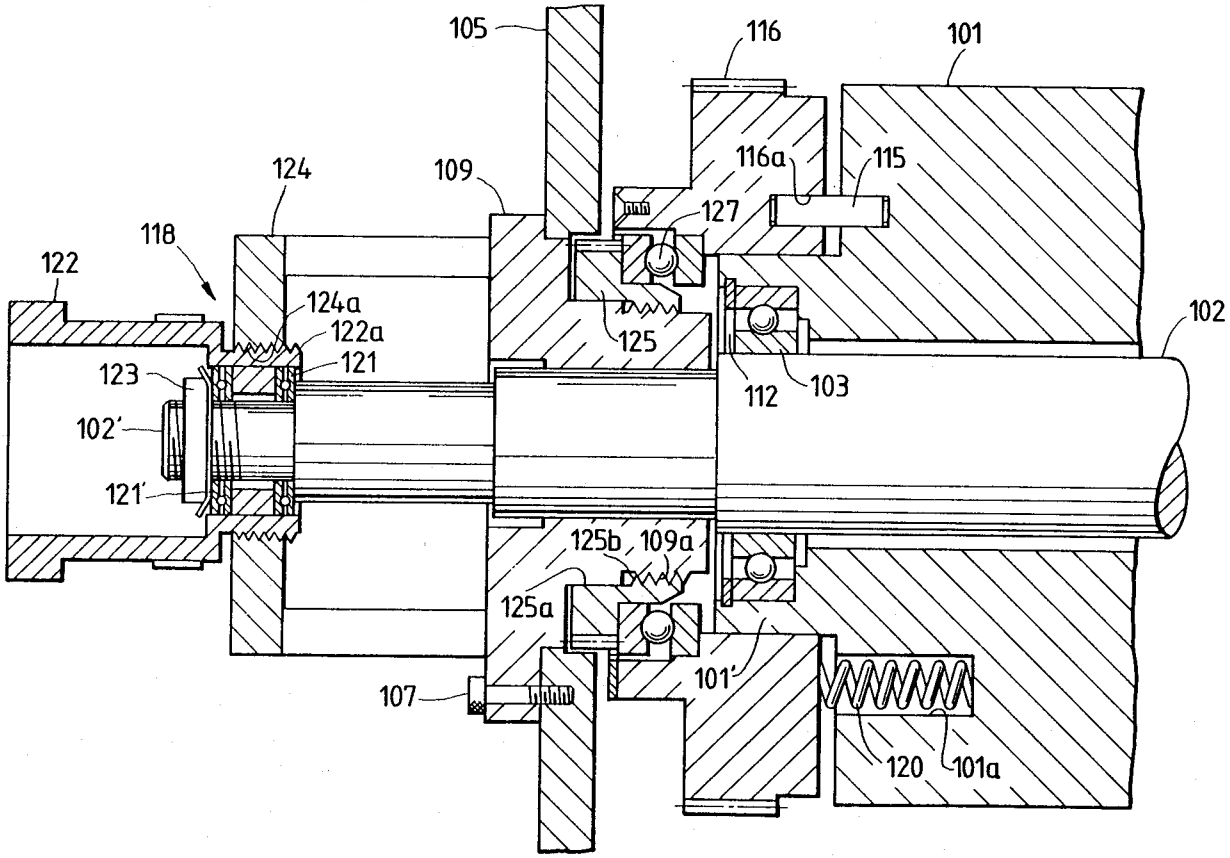
FIG. 11 is a view similar to that in FIG. 3 but sectioned along a different line than FIG. 9.
Figure 12:
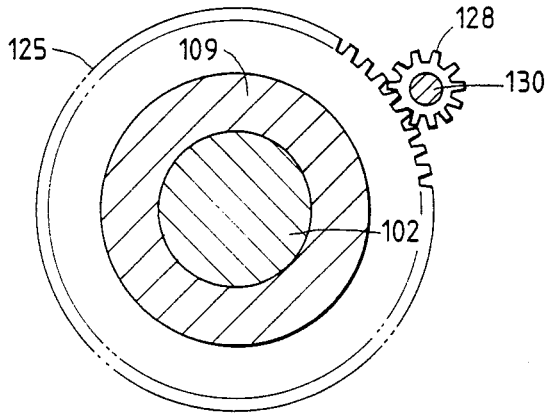
FIGS. 12 and 13 are cross-sectional views along lines XII—XII and XIII—XIII, respectively.
Figure 13:
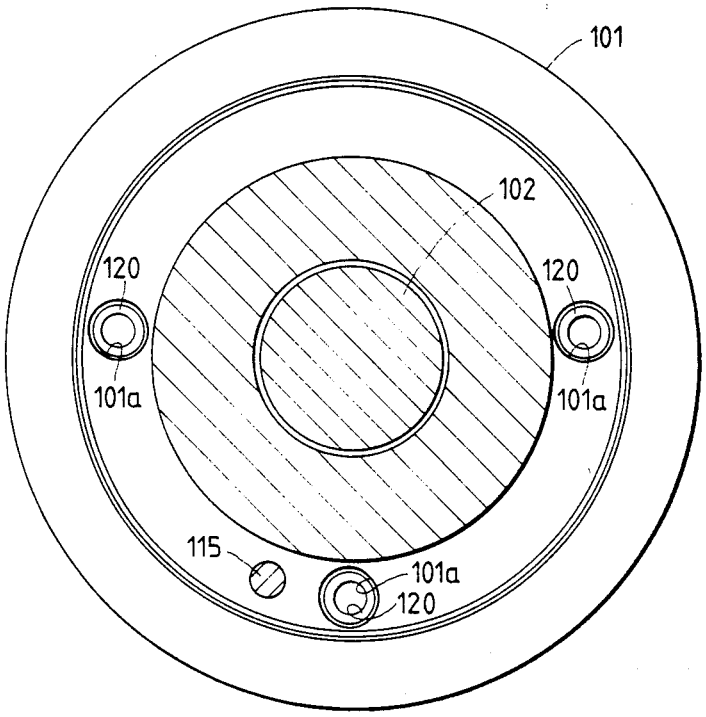

The collar 37 is secured by a number of screws 39 and the lock plate 38 is placed within a ring-like cavity 16*a* formed at a side face of the bevel gear 16. A half portion of a pressure plate 41 (FIGS. 1 and 8) having a trapezoid-like cross-section is fitted in a hole 37*a* formed through the collar 37 along its diametric direction. Another half portion of the plate 41 is fitted into a cut-off portion 38*a* of the lock plate 38.

At both right and left end faces of the cut-off portion 38*a* there are slanted faces 38*b* opposing additional slanted faces 41*a* arranged symmetrically at the left and right of the pressure plate 41. The pressure plate 41 is secured to the holder 15 using screws 40. Fastening the screws 40 between the slanted faces 38*b* and 41*a* increases the diameter of the lock plate 38 and presses the lock plate 38 against an inner peripheral face of the cavity 16*a* As a result, the bevel gear 16 is secured to the holder 15. When the screw 40 is loosened, the diameter of the lock plate 38 is reduced and the force which presses the lock plate 38 into the ring-like cavity 16*a* is reduced. In turn, the connection between the bevel gear 16 and the holder 15 is loosened.

The screw 40 is also inserted in an oval hole 16*b* which extends along the periphery of the bevel gear 16. Due to this construction, the bevel gear 16 can be rotated by a predetermined angle relative to the holder 15. Loosening the screw 40 also enables free rotation of the rotary pin 35 with respect to left and right directions (in FIGS. 1–3) and causes the pinion 36 to engage the segment gear 33. This engagement enables relatively large changes in the rotational phase of the printing cylinder 1 and the bevel gear 16 to be effected. Thus, rough vertical adjustment of the image position can be achieved. As shown in FIG. 3, securing the screw 40 after it has been adjusted secures the holder 15 and the bevel gear 16.

At a side face of the printing cylinder 1 which opposes the bevel gear 16, there is a drive pin 42 having a half portion buried so as to extend parallel to the shaft 2. An end portion of the drive pin 42 is fitted into a hole 37*b* formed in the collar 37. A compression spring 43 is inserted in a cavity 1*a* and the spring 43 is elastically pressed against a side face of the collar 37.

When an operator rotates the handle 22 of the transverse adjusting mechanism 18, the handle 22 will move along its axis relative to the holder 24, so that the shaft 2, together with the cylinder 1. slides axially relative to the bearings 9 and 10. Consequently, the phase of the printing cylinder 1 changes relative to that of the rubber cylinder to adjust the position of the image in the transverse direction.

During transverse adjustment, the gear 16 is restrained by action of the gear 9, the slide gear 25, and the holder 15, so that the gear 16 does not move in spite of the compression spring 43.

When an operator rotates the handle attached to the bevel gear 32 of the vertical adjusting mechanism 19, a rotary force is given to the slide gear 25 through the gear transmission mechanism 26. In response, the slide gear 25 moves along its axis due to the threaded engagement with the bearing 9. As a result, the holder 15 and the bevel gear 16 slide axially through the slide gear 27. In the position shown in FIG. 1, the holder 15 and gear 16 are slid to the left by the elastic force of the compression spring 43. When the bevel gear 16 slides as mentioned above, it engages a bevel gear of the rubber cylinder and rotates a small amount which changes its phase relative to the rubber cylinder to vertically adjust the image position. Thus, a fine vertical adjustment of the image position is carried out.

To coarsely adjust the image position in the vertical direction, the screw 40 is loosened and the rotary pin 35 is rotated, so that the bevel gear 16 rotates and changes its peripheral phase relative to the printing cylinder 1.

A second embodiment of the image adjusting apparatus according to the present invention will now be described with reference to FIGS. 9–13.

In the second embodiment, a printing cylinder 101 is rotatably supported on a shaft 102 through bearings 103 and 104 which prevent the cylinder 101 from moving axially. The shaft 102 is supported by means of a set of bearings 109 and 110 so as to slide axially, and the cylinder 101 moves axially together with the shaft 102. The bearings are secured to a first (operative) side frame 105 and a second (opposite-operative) side frame 106 by screws 107 and 108, respectively. Stop rings 112 and 113, as well as screws 11 and a nut 114, are used to secure the bearings 103 and 104 to the printing cylinder 101.

A ring-like portion 101' projects in its axial direction from the printing cylinder 101 toward the first side frame 105. A printing cylinder bevel gear 116 is disposed around the ring-like protrusion 101' so as to rotate and slide axially with respect to the protrusion. The bevel gear 116 engages a bevel gear of a rubber cylinder (not shown). An ink drive gear 117 is secured to the printing cylinder 101.

Both a transverse adjusting mechanism 118 and a vertical adjusting mechanism 119 are provided outside the first side frame 105. The transverse adjusting mechanism 118 is constructed as described below.

A handle 122 is rotatably secured via a pair of thrust bearings 121, 121' to a first end 102' of the shaft 102 which extends outside of a housing of the rotary press. The housing can be provided around the frames 105 and 106, or the housing can be formed so as to include the frames 105 and 106. The handle 122 is secured using a nut 123. A threaded portion 122*a* of the handle protrudes axially from an inside face of the handle 122 and engages a threaded hole 124*a* formed so as to pass through the holder 124. The handle 122 is thus reciprocatable in the axial direction of the cylinder 1. The holder 124 is secured to the outside of the bearing 109. Accordingly, the shaft 102, together with the cylinder 101, slides axially relative to the holder 124. Sliding the shaft and cylinder changes the phase of the cylinder relative to that of a rubber cylinder (not shown) so as to change the transverse position of the image.

The vertical adjusting mechanism 119 is constructed as described below.

A slide gear 125 is engaged with a threaded portion 109*a* formed on the outer circumference of an inner end of the bearing 109 so that rotation of the gear 125 will cause axial movement thereof. The slide gear 125 has a central hole 125*a* having a female threaded portion 125*b* on the inner surface of an inner end portion of the central hole 125*a*. To rotate the slide gear 125, a gear transmission mechanism 126 is provided outside of the first side frame 105. The transmission mechanism 126 thus controls reciprocation of the slide gear 125 by causing the bevel gear 116 to slide axially by means of thrust bearing 127. The bearing 127 is interposed between the side gear 125 and the bevel gear 116. The bevel gear 116 formed on the cylinder 101 engages the bevel gear of the rubber cylinder so as to allow axial sliding of the bevel gear 116. Thus, the printing cylinder is rotatable by a small amount to enable fine vertical adjustment of the image.

In the transmission mechanism 126, a rotary shaft 130 has an inner pinion 128 and an outer bevel gear 129, respectively, secured thereto. The shaft 130 is rotatably supported by bearings 131 and 131' arranged outside the frame 105 and is parallel to the shaft 102. The pinion 128 engages the slide gear 125 and the bevel gear 129 engages a bevel gear 132 provided with a rotatable handle (not shown) disposed outside the frame 105. Rotation of the bevel gear 132 causes the slide gear 125 to reciprocate with respect to the shaft 102.

At a side face of the printing cylinder 101 opposing the bevel gear 116, a drive pin 115 (FIG. 11) is buried approximately to half its length. The pin 115 extends parallel to the shaft 102. An end portion of the pin 115 is fitted into a cavity 116*a* formed in a side face of the bevel gear 116. A compression spring 120 is inserted into a cavity 101*a* formed in the cylinder 101, and the spring presses against the side face of the bevel gear 116.

When an operator rotates the handle 122 of the transverse adjusting mechanism 118, the threaded engagement of the handle and holder 124 translates the rotation into axial movement of the handle relative to the holder 124. The axial movement of the handle causes the shaft 102, together with the cylinder 101, to slide axially relative to the frames 105 and 106. Accordingly, the phase of the printing cylinder 101 changes relative to that of the rubber cylinder to transversely adjust the position of the image.

During adjustment of the image, the bevel gear 116 is restrained from sliding due to the threaded engagement of the bearing 109 and slide gear 125, so that the force of the spring 143 cannot move the bevel gear 116.

When an operator rotates a handle (not shown) attached to the bevel gear 132 of the vertical adjusting mechanism 119, a rotary force is given to the slide gear 125 through the gear transmission mechanism 126. Due to the threaded engagement of the slide gear and bearing 109, rotation of the slide gear 125 is translated into axial movement thereof. This axial movement causes the bevel gear 116 to move axially, through the slide bearing 127. Thus, the bevel gear 116 slides leftwards (in FIG. 9) due to the elastic force of the compression spring 143.

When the bevel gear 116 slides as described above, it engages the rubber cylinder bevel gear to cause rotation of the printing cylinder a relatively small amount along its peripheral direction. This rotation changes the phase of the printing cylinder relative to that of the rubber cylinder. Consequently, the image printing position moves in the vertical direction. Thus, fine vertical adjustment of the image is achieved.

According to the first embodiment of the present invention, the position adjusting apparatus for a rotary press has a transverse adjusting mechanism 18 and vertical adjusting mechanism 19 which are each operable by using one handle 22. These adjusting mechanisms function to finely adjust an image on the printing cylinder in the transverse and vertical directions, respectively, without any special tool and without a specially-trained operator. The adjustment operation can be precisely performed while the operator watches the rotary press print the image. Rough vertical adjustment of the image can be easily performed merely by rotating the screw 40 and rotary pin 35 situated between the frame 5 and the printing cylinder. All three of the image adjusting mechanisms 18, 19 and 20 are situated at the operator's side of the rotary press, so that the operator need not walk around the frame of the printing machine to another position, e.g., to the side opposite to the operator's side. Image position adjustment can be quickly and easily performed and the drive force transmission mechanism is situated outside the frame which enables the mechanism to be freely designed. The bearings 9 and 10 on the frames slidably support the printing cylinder shaft, so that a simple construction of the bearings and a low cost for manufacturing them are advantageously attained.

In the second embodiment of the image position adjusting apparatus of the present invention, a transverse adjusting mechanism 118 and a vertical adjusting mechanism 119 are provided. These position adjusting mechanisms are operated merely by using the handle 122 to adjust the position of the image with respect to the transverse and vertical directions without any special tool and without a specially trained operator. Adjustment can be performed accurately while the operator watches the rotary press print the image. These image adjusting mechanisms 118 and 119 are situated at the operator's side of the rotary press. The image position adjustment can be quickly and easily performed. The drive force transmission mechanism is situated outside of the frame which enables the mechanism to be freely designed. The bearings 109 and 110 of the frames 105 and 106 need only slidably support the printing cylinder shaft 102, so that these bearings are advantageously constructed simply and manufactured at low cost.

What is claimed is:

1. In an apparatus for adjusting a position of an image to be printed by a rotary printing machine in first and second directions, the printing machine having a printing cylinder, a shaft, a frame defining an inside and an outside, the printing cylinder being disposed on the inside, a bevel gear associated with the printing cylinder, and a rubber cylinder with a bevel gear for engagement with said printing cylinder bevel gear, the improvement wherein the apparatus comprises:

a plurality of first bearing means, supported on the frame, for supporting the shaft for axial movement in the second direction, the shaft having an end portion extending through the frame to the outside thereof, wherein the shaft is provided for supporting the printing cylinder for rotation;

second bearing means for supporting the printing cylinder for rotation relative to the shaft, and for axial movement in response to axial movement of the shaft;

a first handle mounted on the end portion of the shaft;

first translating means for translating rotation of the handle into axial movement of the shaft, the first translating means including a first holder mounted outside the frame and in fixed relation to the frame;

a first gear rotatably mounted outside the frame;

second translating means for translating rotation of the first gear into axial movement of the printing cylinder bevel gear; and supporting means for rotatably and slidably supporting the printing cylinder bevel gear on the printing cylinder such that axial movement of the printing cylinder bevel gear causes relative rotation between the printing cylinder bevel gear and the rubber cylinder bevel gear which causes relative rotation between the printing cylinder and the rubber cylinder for adjusting the printing of the image in the first direction.

2. The apparatus according to claim 1, wherein the supporting means comprises a compression spring and a pin having axes parallel to the shaft.

3. The apparatus according to claim 1, wherein the first holder is threadedly engaged with the handle.

4. The apparatus according to claim 1. wherein the second translating means comprises a slide gear threadedly engaged with one of said plurality of first bearing means, and a thrust bearing cooperating with said slide gear, and axially movable in response to axial movement of the slide gear.

5. The apparatus according to claim 4. wherein the second translating means further comprises a second holder for suppporting the printing cylinder bevel gear and mounted for axial movement in response to axial movement of the thrust bearing, the printing cylinder bevel gear being axially movable together with the second holder.

6. The apparatus according to claim 5, further comprising means for rotating the printing cylinder bevel gear relative to the second holder.

7. The apparatus according to claim 6, wherein the means for rotating the printing cylinder bevel gear relative to the second holder comprises a screw fitted in a hole defined in the printing cylinder bevel gear.

8. The apparatus according to claim 7, wherein the means for rotating the printing cylinder bevel gear relative to the second holder further comprises an adjusting pin, and wherein rotation of the screw to a first position enables free rotation of the adjusting pin, and rotation of the screw to a second position fixes the rotary pin with respect to the second holder.

9. The apparatus according to claim 8, wherein the means for rotating the printing cylinder bevel gear relative to the second holder further comprises a third gear which is disposed on the inside of the frame and fixed to the second holder, a pinion for engaging the third gear when the screw is rotated to the first position, and means for rotatably supporting the pinion on the second holder.

10. In an apparatus for adjusting a position of an image to be printed by a rotary printing machine in lateral and vertical directions, the printing machine having a printing cylinder, a shaft, a frame defining an inside and an outside, the printing cylinder being disposed of the inside, a bevel gear associated with the printing cylinder, and a rubber cylinder with a bevel gear for engagement with said bevel gear of said printing cylinder, the printing cylinder being slidable together with an axis thereof as against the frame to adjust the position of the image in the lateral direction and the printing cylinder being rotatable with respect to its axis to adjust the position of the image in the vertical direction, the improvement wherein the apparatus comprises:

first bearing means, supported on the frame, for supporting the shaft for axial movement in the lateral direction, the shaft having an end portion extending through the frame to the outside thereof, wherein the shaft is provided for supporting the printing cylinder for rotation in the vertical direction;

second bearing means for supporting the cylinder for rotation relative to the shaft, and for axial movement in response to axial movement of the shaft;

a first handle mounted on the end portion of the shaft;

first translating means for translating rotation of the handle into axial movement of the shaft, the first translating means including a holder mounted outside the frame and in fixed relation to the frame;

a first gear rotatably mounted outside the frame;

second translating means for translating rotation of the first gear into axial movement of the printing cylinder bevel gear; and supporting means for rotatably and slidably supporting the printing cylinder bevel gear on the printing cylinder such that axial movement of the printing cylinder bevel gear causes rotation of the printing cylinder to be effected by engaging said bevel gear of the rubber cylinder, whereby the vertical position of the image to be printed is adjusted.

* * * * *